United States Patent [19]

Ginn, Jr.

[11] Patent Number: 4,655,020

[45] Date of Patent: Apr. 7, 1987

[54] CINCH STRAP AND BACKUP PLATE FOR METAL ROOF ENDLAP JOINT

[75] Inventor: Albert R. Ginn, Jr., Magnolia, Tex.

[73] Assignee: Metal Building Components, Inc., Houston, Tex.

[21] Appl. No.: 847,691

[22] Filed: Apr. 3, 1986

[51] Int. Cl.[4] ..... E04D 1/34

[52] U.S. Cl. ..... 52/551; 52/521; 52/545

[58] Field of Search ..... 52/551, 544, 545, 549, 52/521, 478

[56] References Cited

U.S. PATENT DOCUMENTS

| | | | |
|---|---|---|---|
| 3,302,353 | 2/1967 | DuPradal | 52/521 X |
| 3,481,094 | 12/1969 | Taylor . | |
| 3,975,880 | 8/1976 | Fischer, Jr. . | |
| 3,998,019 | 12/1976 | Reinwall, Jr. . | |
| 4,034,532 | 7/1977 | Reinwall, Jr. . | |
| 4,037,372 | 7/1977 | Patry . | |
| 4,102,105 | 7/1978 | Taylor et al. . | |
| 4,497,151 | 2/1985 | Simpson et al. . | |

FOREIGN PATENT DOCUMENTS

| | | | |
|---|---|---|---|
| 2248886 | 4/1973 | Fed. Rep. of Germany | 52/545 |
| 2256584 | 3/1980 | Fed. Rep. of Germany | 52/545 |

*Primary Examiner*—William F. Pate, III
*Assistant Examiner*—Creighton Smith
*Attorney, Agent, or Firm*—Arnold, White & Durkee

[57] ABSTRACT

An improved cinch strap and backup plate, used to form an enlap joint between two overlapping roofing panels, is disclosed. The backup plate is provided with horizontally extending shoulders which protrude outwardly from each end of the plate. One shoulder provides support for the endlap joint during its assembly, while the other shoulder provides support for later installed endlap joints. The cinch strap is configured to conform to the contour of the roofing panels. The cinch strap is provided with spines which provide structural support, and drainage channels which help to clear moisture from the roof. The cinch strap is configured so as to engage other, aligned cinch straps in a head-to-tail arrangement. The improved cinch strap and backup plate provide a structurally stronger, weatherproof endlap joint.

30 Claims, 9 Drawing Figures

Fig. 1
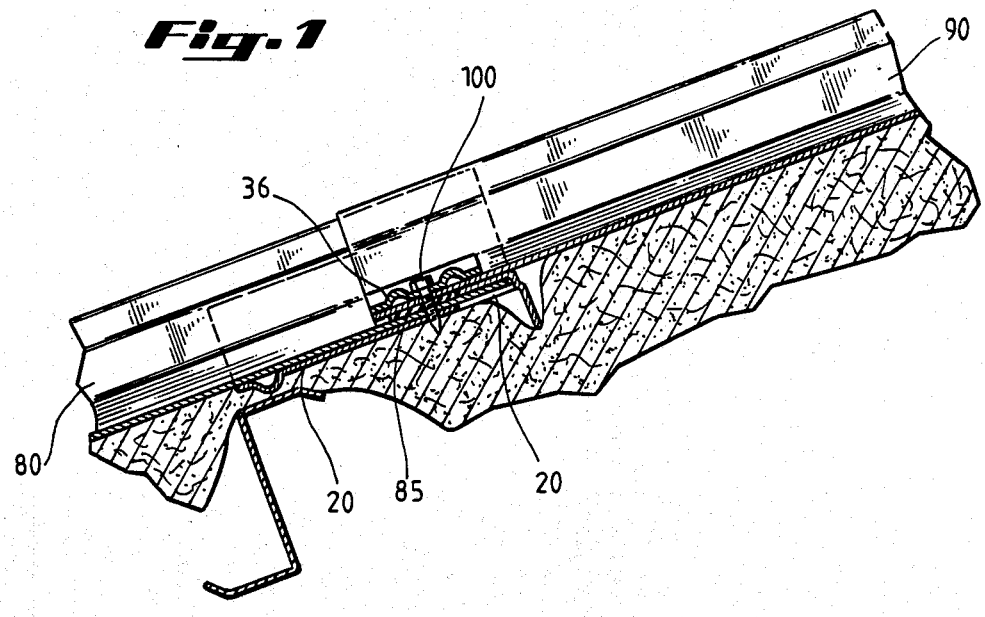
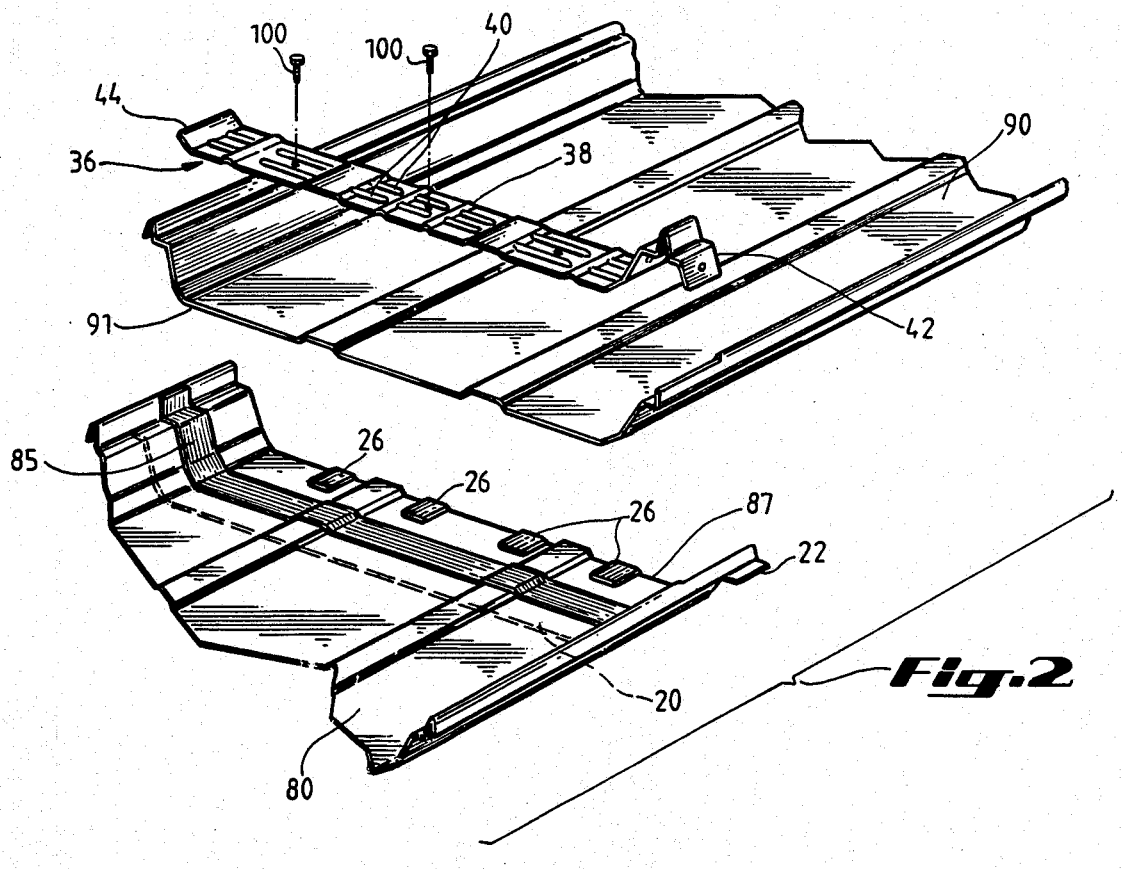
Fig. 2

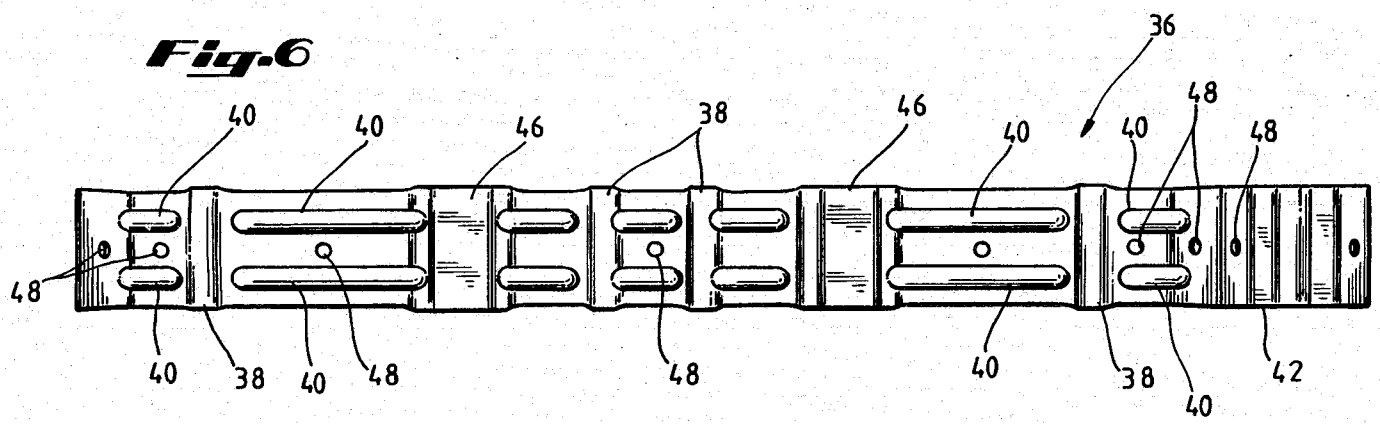
Fig. 6
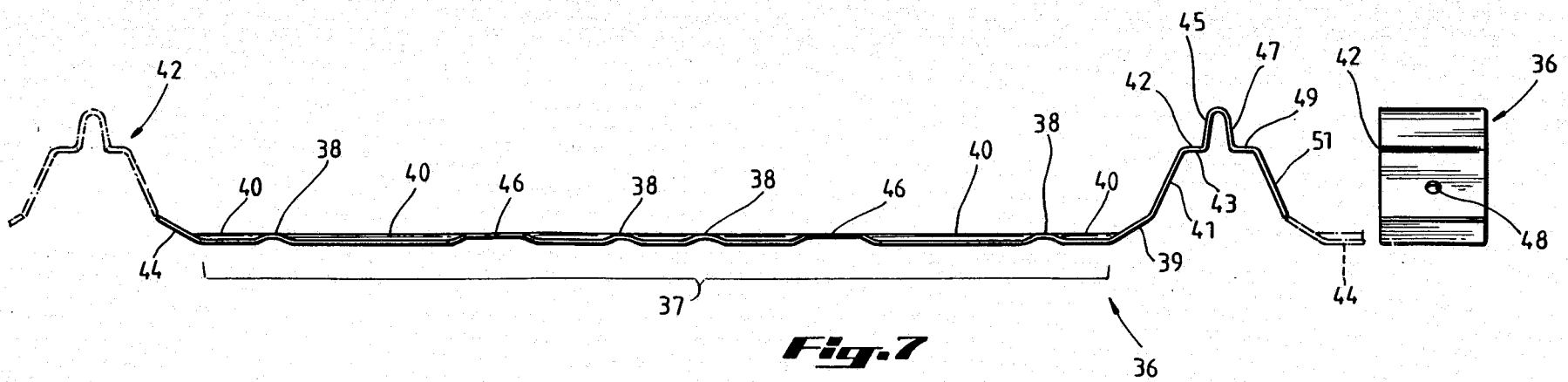
Fig. 7
Fig. 8

CINCH STRAP AND BACKUP PLATE FOR METAL ROOF ENDLAP JOINT

BACKGROUND OF THE INVENTION

There are many possible ways to provide a roof for a structure. One way to roof a structure is through the use of metallic roofing panels. The art of roofing structures with metallic roofing panels has advanced to the use of standing seam roofing panels. Standing seams are formed when raised longitudinal edges of roofing panels engage to form a longitudinal ridge running from the peak to the gutter of a roof.

Standing seam metallic roofing panels are normally manufactured from galvanized steel or GALVALUME (TM) and then may be painted or coated with a protective film. The individual panels may vary in width from one to several feet, and may be up to thirty feet in length.

In erecting a structure, walls or columns of the building are first built and rafters, which form the primary roof support, are carried by the walls or columns. These rafters usually span the width of the structure. Joists, or purlins, are load across the rafters, are supported by the rafters, and are normally installed perpendicularly to the rafters, thereby defining the roof line. The purlins extend along the length of the building. Insulation may be laid across the joists.

A standing seam roofing system may then be installed. Roofing panels are joined together along adjacent longitudinal sides in a male/female joint to form the standing seams. It is known in the art how to attach the roofing panels to the joists, or purlins.

In structures where the distance from the peak to the gutter line is greater than the maximum length of a single roofing panel, it may be necessary to install two or more lengths of roofing panels to provide a roof. Endlap joints are formed where the end of one panel overlaps the end of an abutting panel. It will be understood by one skilled in the art that the lower end of the roofing panel, located nearest to the peak of a roof, will overlap the upper end of an abutting roofing panel, located closer to the gutter line of the roof, in a shingle-like manner.

At the point where the two roofing panels overlap, creating an endlap joint, it is necessary to secure the panels together in order to maintain the structural integrity of the roof and to provide a weatherproof seal between the panels. In Gulf Coast aareas where frequent high winds and heavy rains are experienced, it is necessary to maintain an endlap joint that can provide a seal against driving rain and still be strong enough to resist the lifting force of high winds. Very frequently, the atmosphere in the interior of the structure may be air-conditioned. In the process of doing this, the atmospheric pressure may become greater than the pressure in the building and rain-water running over the roof may be sucked through the endlap joint if the joint is not watertight.

In areas of the countery where roofing systems experience seasonal snow loadings, it is imperative to provide an endlap joint of sufficient strength to resist the occasionally high stresses placed on the roof by the snow in order to protect the structural integrity of the roof.

Finally, the endlap joint formed by the overlapping roofing panels must be strong enough to resist "live loads" occasioned by workmen walking on the roof during maintenance of the structure.

The present invention provides a means for creating an endlap joint between overlapping roofing panels that provides structural strength to the roofing system while maintaining a watertight seal against environmental forces.

SUMMARY OF THE INVENTION

To assemble an endlap joint in accordance with the present invention, a first, lower roofing panel is placed adjacent to a roofing panel which forms the lower half of the already assembled endlap joint. It will be understood by one skilled in the art that a "lower" element in a roofing system refers to an element that is nearer the gutter line than the peak of the roof. Similarly, a "higher" element is an element located nearer to the peak of the roof. The first roofing panel is placed so that the longitudinal edge of the panel nearest to the installed panel engages the edge of that panel and creates a standing seam. The first roofing panel is placed so that the upper end of the panel is positioned adjacent to the upper end of the adjacent, already installed roofing panel.

A channel-shaped backup plate is inserted below the first panel and is positioned adjacent to, and aligned with, a backup plate that has already been assembled into the adjacent endlap joint. A backup plate according to the present invention is provided with a horizontal "shoulder" which extends outward horizontally from the raised ends of the plate. A shoulder of the plate is positioned so that it rests on top of a shoulder of an adjacent, installed plate.

A second roofing panel is then placed adjacent to the upper roofing panel of the already assembled endlap joint. The second roofing panel is placed so that a longitudinal edge of the panel forms a standing seam with the upper panel of the already assembled endlap joint. The second panel is positioned so that its lower end overlaps the first roofing panel and the backup plate beneath it.

A cinch strap according to the present invention is then placed over the second panel so that the upper longitudinal edge of the strap is positioned over the upper edge of the backup plate. In accordance with the present invention, one end of the strap has been formed so as to be engageable with the exterior contour of the standing seam formed by the junction of the four roofing panels. The strap is placed so that this formed end overlaps the standing seam and abuts an end of the adjacent cinch strap of the already assembled endlap joint.

Finally, self-drilling fasteners are applied to preformed holes in the cinch strap. The fasteners draw this strap and the backup plate together, thereby sandwiching the two roofing panels between them to form the endlap joint.

When assembling an endlap joint according to the present invention, a tape mastic or sealant is applied between the two roofing panels at the point at which they overlap each other and the backup plate in order to aid in the formation of a watertight joint.

During application of the fasteners to the cinch strap, the endlap joint must be supported. A common method of supporting the endlap joint has been placing workers, often on scaffolding, beneath the backup plate who manually support the plate, and thereby the endlap joint, during assembly. This method has been both costly and time consuming. Another, more common method of assembling endlap joints involves pre-punching holes in the cinch strap, roofing panels, and backup plate and inserting fasteners through the aligned, preformed holes. Although this method may at first appear to be an easy way to assemble endlap joints, it has been found to have several practical drawbacks.

Initially, this latter method has proven to be very difficult to accomplish in the field. Due to the nature of the tolerances associated with standing-seam roofing systems and their assembly in the field, it is difficult, as a practical matter, to align all the preformed holes in each of the cinch strap, backup plate, and roofing panels. To further complicate matters, once the roofing panels engage and interlock with adjacent panels to form the standing seam, it is not practical to slide the panels longitudinally along the seam. Therefore, the holes in each of the panels must be aligned before both panels engage the adjacent roofing panels; this is often a laborious process.

There is a second major drawback to pre-punched hole method of assembling endlap seams. As stated, it is often necessary to position and reposition the roofing panels in order to align the pre-punched holes. Once this is accomplished, it is still necessary to align the holes in the cinch strap and backup plate with the holes in the roofing panels. Often, a rod is inserted into the holes to align them. The insertion of the rod, and the jockeying of the various components, often damages the mastic positioned between the roofing panels resulting in an imperfect water seal in the endlap joint.

The present invention avoids all the above-mentioned difficulties. According to the present invention, the endlap joint is supported by the backup plate through the use of the horizontal shoulder of the backup plate resting on top of the shoulder of the adjacent plate in the already assembled endlap joint. Because the backup plate is so supported, it is no longer necessary to have the plate independently supported during assembly of the endlap joint, and because the plate is so supported self-drilling fasteners may be used without resorting to pre-punched holes in the component.

Other roofing systems have relied solely on retaining tabs, formed in the backup plate, to support the plate during assembly of the endlap joint. This has not proven to be entirely effective and additional plate support is often required. The additional support that is required to effectively support the backup plate during assembly of the endlap joint is efficiently provided by the support shoulders of a backup plate according to the present invention.

Further, once the roof has been completely assembled, the overlapping horizontal shoulders of the aligned backup plates will provide additional support to the whole roof. This additional support helps to protect the integrity of the entire roofing system during periods of heavy weather or when workmen are walking about on the roof.

BRIEF DESCRIPTION OF THE DRAWINGS

FIG. 1 is a sectional view of an assembled endlap joint according to the present invention.

FIG. 2 is an exploded view of the components comprising an endlap joint according to the present invention.

FIG. 6 is a plan view of the cinch strap incorporating the present invention.

FIG. 7 is a side view of the cinch strap depicted in FIG. 6.

FIG. 8 is an end view of the cinch strap depicted in FIG. 6.

DETAILED DESCRIPTION OF THE PREFERRED EMBODIMENT

Figure 5:
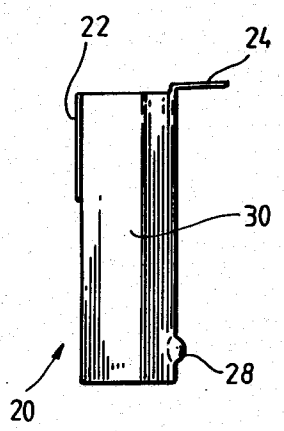
FIG. 5 is an end view of the backup plate depicted in FIG. 3.
Figure 3:
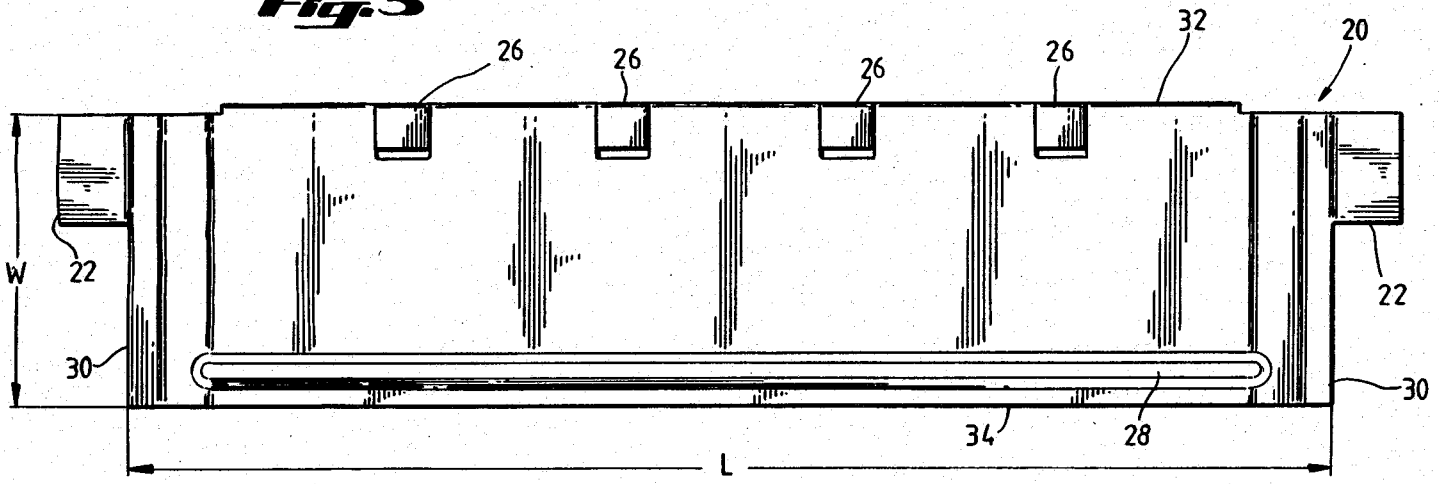
FIG. 3 is a plan view of a backup plate incorporating the present invention.
Figure 4:
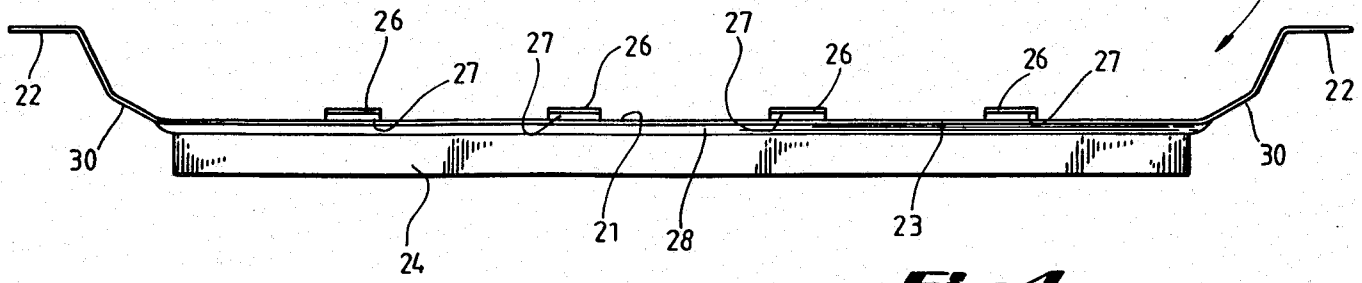
FIG. 4 is a side view of the backup plated depicted in FIG. 3 facing the lower side of the backup plate.

Referring to FIGS. 1 and 2, an endlap joint according to the present invention is comprised of six different types of components: a backup plate 20; a lower roofing panel 80; tape mastic or sealant 85; an upper roofing panel 90; a cinch strap 30; and a plurality of fasteners 100.

Details of the backup plate 20 will be discussed first. Referring to FIGS. 1–5 and 9, each backup plate 20 is defined by a length (depicted in FIG. 3 as "l"), corresponding directionally to the width of the roofing panels 80 and 90, and a width (depicted in FIG. 3 as "w"). A backup plate 20 according to the present invention is basically channel-shaped and configured to follow at least part of the interior configuration of the roofing panels 80 and 90. Positioned at the ends 30 of the backup plate 20 are laterally outward extending shoulders 22. Each shoulder 22 may be used to support the backup plate 20, and to provide support for an adjacent backup plate.

In one embodiment of the present invention, a backup plate 20 may be formed from sheet, or coil, steel in a metal stamping operation.

Preferably, the outwardly extending shoulders 22 of the backup plate 20 are provided adjacent to the upper edge 32 of the backup plate 20. In accordance with the present invention, the shoulders 22 extend outwardly from the ends 30 of the backup plate 20 beyond the centerline of the upstanding seams formed by adjacent, interlocked roofing panels.

Preferably, the width of the shoulders 22 equal approximately one third of the width of the backup plate 20.

In accordance with the present invention, a plurality of retaining tabs 26 are provided adjacent the upper edge 32 of the backup plate 20 in order to receive an upper end of the lower roofing panel 80.

The backup plate 20 is provided with a vertical reinforcing surface 24, which extends downwardly from the upper edge 32 of the backup plate 20, and a longitudinal support groove 28 formed in the backup plate 20 adjacent to, and parallel with, the lower edge 34 of the plate 20.

In a preferred embodiment of the present invention, the retaining tabs 26 extend upwardly from the upper edge 32 of the backup plate 20, then horizontally toward the lower edge 34 of the plate 20, parallel to the plate 20. The tabs 26 are formed in the plate 20 so that the thickness of the lower roofing panel 80 may be received between the upper surface 21 of the plate 20 and the lower surface 27 of the horizontal sections of the retaining tabs 26. The retaining tabs 26 may generally be one inch square.

The cinch strap will now be discussed. Referring to FIGS. 1, 2, and 6–8, each cinch strap 36 is defined by a length, which corresponds to the width of the surface of the upper roofing panel 90, and a width. A first raised end 44 which is engageable with a portion of one surface of a standing seam. A second raised end 42 which is generally in the shape of an inverse "V" is configured to engage the outer contour of the opposite standing seam formed by the roofing panel 90. It will be understood that defining raised end 42 as an "inverse V-shape" is in no way limiting the configuration of end 42, but rather is used to describe how end 42 is configured to engage the standing seam formed by the roofing panels.

Figure 9:
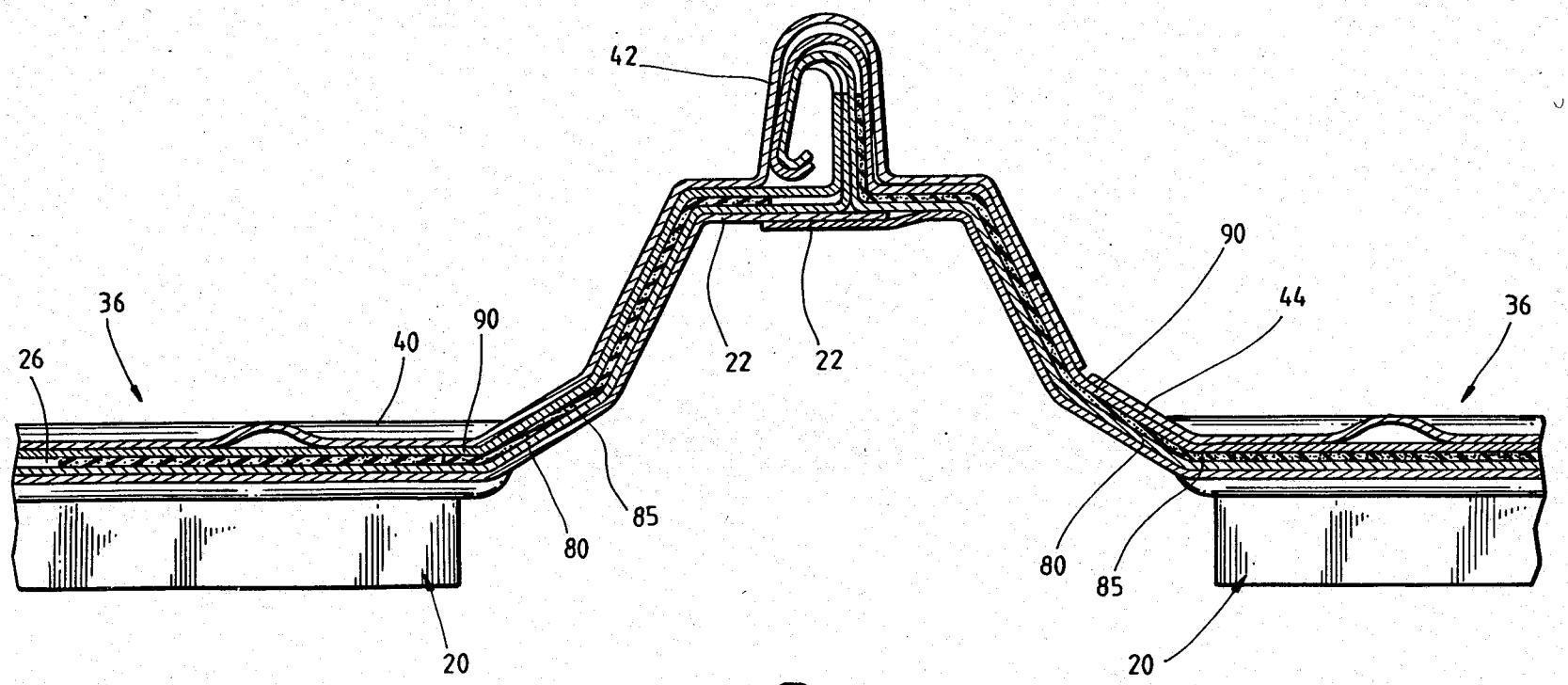
FIG. 9 is another section view of an assembled endlap joint according to the present invention.

In the embodiment depicted in FIGS. 2 and 9, raised end 42 is composed of a number of connected surfaces. Referring particularly to FIG. 7, raised end 42 is attached to the elongated main body portion 37 by a raised base surface 39 which is configured to engage a portion of a standing seam. A first upwardly directed side surface 41 extends upwardly and outwardly from base surface 39, following the contour of the standing seam. A first substantially horizontal surface 43, a second upwardly directed side surface 45, a first downwardly directed side surface 47, and a second substantially horizontal surface 49 define a summit which engages, and caps, the peak of the standing seam. Finally, a second downwardly directed side surface 51 extends outwardly from the second substantially horizontal surface 49, and is engageable with the end 44 of an adjoining cinch strap.

Referring particularly now to FIG. 6, in a preferred embodiment of the present invention, the cinch strap 36 is provided with a pair of longitudinal reinforcing spines 40. A plurality of transverse drainage channels 38 are provided which facilitate the drainage of rainwater and the like from the roof by facilitating the flow of water from one longitudinal side of the cinch strap 36 to the other. The drainage channels 38 are formed perpendicular to the longitudinal centerline of the cinch strap 36. In order to facilitate the drainage of water from the top of the cinch strap 36, reinforcing spines 40 may intersect raised ends 42 and 44 and not intersect the drainage channels 38 located proximate ends 42 and 44. Further, reinforcing spines 40 may intersect only one side of the drainage channels 38 provided proximate the transverse centerline of the strap 36 in order to provide a path for water to drain.

In a preferred embodiment, the cinch strap is formed to accommodate a ribbed roofing panel. Ribs are generally provided in the planar web, or substantially flat, horizontal, main body portion 37 of the roofing panels 80 and 90. In this embodiment of the invention, deformations 46 are provided in the strap 36, thereby allowing the strap to conform to the contour of the roofing panel 90. Roofing panels 80, 90 may be ribbed in order to increase their structural strength.

Reinforcing spines 40 perpendicularly intersect deformations 46 and drainage channels 38 formed throughout the strap. Holes 48 are formed along the longitudinal centerline of the strap 36 in order to receive self-drilling fasteners 100 which, when applied to the endlap joint, draw the backup plate 20 and the cinch strap 36 together, thereby sandwiching the roofing panels 80 and 90 between them.

The length of the cinch strap 36 is such that contoured end 42 of the straap 36 extends down the outer face of the standing seam formed with the preinstalled roofing panels so that the end 42 of the strap 36 engages the end of 44 of an already installed cinch strap, as depicted in phantom in FIG. 7.

There are several advantages to forming the end 42 of cinch strap 36 to overlap the standing seam formed by the roofing panels. The resultant endlap joint is structurally stronger when the cinch strap 36 engages the standing seam over the top of the seam. Additionally, a more aesthetically-pleasing roof results when the aligned cinch straps 36, arranged in a head-to-tail relationship, completely cover the standing seams formed by the adjacent roofing panels.

Referring now to FIGS. 1 through 9, when assembling an endlap joint according to the present invention, a first lower roofing panel 80 is positioned so that the upper end 87 of the roofing panel 80 is adjacent to the upper end of an already installed roofing panel while the remainder of the roofing panel 80 extends toward the gutter line.

A longitudinal edge of the first roofing panel 80 engages the longitudinal edge of the already installed roofing panel to form a standing seam.

A backup plate 20 is positioned adjacent to an already installed backup plate so that a shoulder 22 of the backupu plate 20 rests on top of a shoulder 22 of the already installed adjacent plate.

The backup plate 20 is positioned so that the upper end 87 of roofing panel 80 is inserted beneath the plurality of retaining tabs 26.

A second, upper roofing panel 90 is then positioned over roofing panel 80 and the backup plate 20. The second roofing panel 90 is positioned so that the lower edge 91 of the panel 90 is positioned above the lower edge 34 of the backup plate 20 while the remaining portion of the roofing panel 90 extends over the upper edge 32 of the backup plate 20 toward the peak of the roof.

A longitudinal edge of the second roofing panel 90 engages a longitudinal edge of an adjacent roofing panel that has already been installed to form a standing seam.

A cinch strap 36 is then placed over the second roofing panel 90. The cinch strap 36 is positioned so that the lower edge of the strap 36 is approximately three inches from the upper edge 32 of the backup plate 20. The contoured end 42 of the strap 36 is placed over the standing seam formed by the combination of roofing panels 80, 90, and the two already installed roofing panels. The contoured end 42 engages the end 44 of an already installed adjacent cinch strap in a head-to-tail relationship.

Finally, a plurality of self-drilling fasteners 100 are inserted into preformed holes 48 in the cinch strap 36. The self-drilling fasteners 100 draw the cinch strap 36 toward the backup plate 20 thereby sandwiching roofing panels 80 and 90 between them and creating a structurally strong, water-tight endlap joint.

The method may then be repeated until the entire roof is in place.

Various modifications and improvements may be made to the disclosed embodiment without departing from the overall scope and spirit of the invention. For example, a tape mastic or sealant 85 may be placed between the overlapping roofing panels 80 and 90 in order to enhance the seal of the endlap joint.

Having therefore fully and completely disclosed the best mode for my invention, I now claim:

1. An apparatus for assembling channel-shaped roofing panels on a roof wherein each panel has a planar web portion and upstanding sidewalls configured to engage the sidewalls of laterally adjacent panels in a male/female relationship to form upstanding seam connections and wherein the lower end of a panel overlaps the upper end of a lower, abutting panel in a shingle-like manner, comprising:

a channel-shaped backup plate having a length corresponding directionally to the width of such panels and configured to be positionable below said panels so that each side of said plate conforms to at least part of the inner configuration of said upstanding seams formed by said panels, the ends of said plate terminating in laterally outward extending shoulders;

a separate cinch strap configured to extend laterally across the width of said overlapping panels so as to sandwich said panels between said backup plate and said strap, one end of said strap configured to overlap a portion of said upstanding sidewall of said panel, and the opposite end of said strap configured to overlap and cover the upstanding seam connection formed by said adjacent panels, said ends of said strap defining a horizontal section of said strap between them; and said strap having at least one longitudinally disposed reinforcing spine and at least one laterally disposed drainage channel, said strap being formed to engage the contour of the upper surface of said roofing panel.

2. An apparatus, as recited in claim 1, wherein said backup plate and said cinch strap are formed from sheet steel.

3. An apparatus, as recited in claim 1, wherein said cinch strap is perforated, proximate the longitudinal centerline of said strap, to receive fastening means to fasten said strap to said backup plate and thereby sandwich said roofing panels between said strap and said plate.

4. An apparatus, as recited in claim 1, wherein said holes in said cinch strap are preformed in said strap material before said strap is formed to engage the contours of a roofing panel.

5. An apparatus, as recited in claim 1, wherein said cinch strap is provided with two longitudinal support spines which perpendicularly intersect deformations formed in said strap to enable said strap to engage the contours of said roofing panel and said drainage channels proximate the center of said strap.

6. An apparatus, as recited in claim 1, wherein said longitudinal support spines are formed into the lower surface of said cinch strap, said spines therefore protruding upwardly from said upper surface of said strap.

7. An apparatus, as recited in claim 1, wherein said longitudinal support spines are formed only in the horizontal portion of said strap.

8. An apparatus, as recited in claim 3, wherein said holes are located between said longitudinal support grooves and are proximate the longitudinal centerline of said cinch strap.

9. An apparatus, as recited in claim 1, wherein said drainage channels formed in said cinch strap are straight and are positioned transversely through said strap, perpendicular to the longitudinal centerline of said strap.

10. An apparatus, as recited in claim 9, wherein said cinch strap is provided with a plurality of said drainage channels positioned in said horizontal section of said strap.

11. An apparatus, as recited in claim 8, wherein said shoulders are formed adjacent to the upper edge of said backup plate, said shoulders extending outwardly, horizontally from said ends of said backup plate beyond the centerline of the upstanding seams of a roofing panel.

12. An apparatus, as recited in claim 1, wherein the width of said shoulders equals approximately one-third of the width of said backup plate.

13. An apparatus for assembling channel-shaped roofing panels on a roof wherein each panel has a planar web portion and upstanding sidewalls configured to engage the sidewalls of laterally adjacent panels in a male/female relationship to form upstanding seam connections, and wherein the lower end of a panel overlaps the upper end of a lower abutting panel in a shingle-like manner, comprising:

a channel-shaped metallic backup plate, said plate having an upper surface and a lower surface, the length of said plate corresponding directionally to the width of said panels, said plate being adapted so that the ends of said plate extend upward from said upper surface of said plate to conform to the inner contour of said roofing panel upstanding seams, said ends of said plate having outwardly extending horizontal shoulders to support said plate and to provide support to adjoining, later installed backup plates, said upper surface of said plate being provided with a plurality of retaining tabs to receive the end of a roofing panel, an upper edge of said plate having a vertical reinforcing surface, said plate further being provided with at least one longitudinal support groove; and a separate metallic cinch strap to secure said roofing panels to said backup plate by sandwiching said panels between said strap and said plate, said strap being configured to extend laterally across the width of said overlapping panels, one end of said strap configured to overlap a portion of said upstanding sidewall, said strap configured at its opposite end to completely overlap and cover the upstanding seam connection formed by said adjacent panels, said strap being provided with at least one longitudinal reinforcing spine and at least one transverse drainage channel, said strap being further configured to engage the contour of the upper surface of a roofing panel, said strap being so configured so as to engage adjoining cinch straps in a head-to-tail arrangement.

14. An apparatus, as recited in claim 13, wherein said drainage channels are formed in the lower surface of said cinch strap so as to protrude upwardly from the upper surface of said cinch strap.

15. An apparatus, as recited in claim 13, wherein said longitudinal support groove is formed into said upper surface of said backup plate and protrudes downwardly from said lower surface of said backup plate.

16. An apparatus, as recited in claim 13, wherein said longitudinal support groove is located proximate said lower edge of said backup plate.

17. An apparatus, as recited in claim 13, wherein said longitudinal support groove is located in the horizontal section of said backup plate.

18. An apparatus, as recited in claim 13, wherein said retaining tabs are located proximate said upper edge of said backup plate and extend upwardly from said upper edge of said backup plate then horizontally toward said lower edge of said plate, parallel to said upper surface of said plate.

19. An apparatus, as recited in claim 18, wherein said tabs formed in said plate have a raised horizontal section parallel to said upper surface of said plate, said tabs being formed so that the thickness of a roofing panel may be received between said upper surface of said plate and the lower surfaces of said horizontal section of said tabs, said retaining tabs being provided in said horizontal section of said plate, said tabs connected to said backup plate only at said upper edge of said plate, and wherein said raised horizontal sections of said tabs are approximately one inch square.

20. An apparatus, as recited in claim 13, wherein said cinch strap is provided with two longitudinal reinforcing spines.

21. An apparatus, as recited in claim 13, wherein said vertical reinforcing surface extends downwardly one inch from said lower surface of said backup plate at said upper edge of said plate.

22. A method for installing roofing panels, comprising the steps of:

forming a channel-shaped metallic backup plate having a length corresponding directionally to the width of such panels, said plate being formed so as to have an upper surface and a lower surface, said plate configured so that each end of said plate extends upwardly from said upper surface of said plate to conform to the inner contour of roofing panel standing seams; said ends of said plate having outwardly extending horizontal shoulders to provide support to adjoining later installed backup plates;

forming a seaparate cinch strap configured to extend laterally across the width of overlapping roofing panels to secure said roofing panels to said backup plate by sandwiching said panels between said strap and said plate, said strap configured at one end to overlap a portion of the upstanding exterior sidewall of a roofing panel, said strap configured at its opposite end to completely overlap and cover the upstanding seam formed by two adjacent roofing panels, said ends defining the middle section of said strap as the horizontal section of said strap;

placing a first roofing panel adjacent to a roofing panel that has already been installed as the lower panel in an endlap joint so that said first panel is parallel to said installed panel and a first end of said first panel is adjacent to an upper end of said installed panel, the remainder of said first panel extending along said installed panel;

positioning said backup plate adjacent to a backup plate which has already been installed so that a shoulder of said backup plate rests on top of a shoulder of the installed backup plate;

positioning said backup plate until said first end of said panel is proximate said upper edge of said plate;

placing a second roofing panel on top of said first panel so that said second panel is parallel to said first panel and said backup plate, and a first end of said second panel is located through the width of said backup plate while the remainder of said second panel extends over said upper edge of said plate opposite said lower edge of said plate in a direction opposite said lower edge;

placing said cinch strap over said second roofing panel so that said strap is parallel to said second panel and a longitudinal edge of said strap matches the edge of said second roofing panel while the remainder of the width of said strap extends toward said upper edge of said backup plate; and fastening said cinch strap to said backup plate, thereby sandwiching said first and second roofing panels between said strap and said plate.

23. A method, as recited in claim 22, wherein said first roofing panel engages an adjacent, already installed roofing panel to form a standing seam at their juncture.

24. A method, as recited in claim 22, wherein said cinch strap is formed so as to be engageable with the external contour of a roofing panel.

25. A method, as recited in claim 24, wherein said cinch strap is provided with a longitudinal support spine which perpendicularly intersects deformations formed in said strap to enable said strap to engage the contours of said roofing panel, and a transverse drainage channels.

26. A method, as recited in claim 22, wherein said longitudinal support spines are formed into the lower surface of said cinch strap and protrude upwardly from said upper surface of said strap in the horizonal portion of said strap.

27. A method, as recited in claim 22, wherein said cinch strap is perforated proximate the longitudinal centerline of said strap to receive fastening means to secure said strap to said plate thereby sandwiching said roofing panels between them, said holes being located between said longitudinal reinforcing spines.

28. A method, as recited in claim 22, wherein said drainage channels formed in said cinch strap are straight and are formed transversely through said strap, perpendicular to the longitudinal centerline of said strap, said drainage channels being formed in the horizontal portion of said cinch strap, which engages said roofing panel between said standing means, said channels being formed left of the transverse centerline of said strap, proximate said transverse centerline, and right of said transverse centerline of said strap.

29. A method, as recited in claim 22, wherein said shoulders extend outward, horizontally from said ends of said backup plate beyond the centerline of the standing seams of a roofing panel, said shoulders being located adjacent said upper edge of said backup plate, the width of said shoulders equaling approximately one-third of the width of said plate.

30. A cinch strap adapted for use to join the overlapping ends of a pair of channel-shaped roofing panels, comprising:

a first upwardly directed, raised end surface;

a substantially planar, elongated main body portion having spaced apart longitudinal sides;

a drainage channel in said main body portion for facilitating the flow of water from one longitudinal side of said main body portion to another longitudinal side of said main body portion; and a second raised end forming a generally inverse V-shape, said inverse V-shape comprising a raised base surface, extending upwardly from said main body portion; a first upwardly directed side surface, extending from said raised base surface; a first substantially horizontal surface, extending outwardly of said main body portion; a second upwardly directed side surface, extending upward and outwardly from said first horizonal surface; a first downwardly directed side surface, extending outwardly from said second upwardly directed side surface, the junction of said second upwardly directed side surface and said first downwardly directed side surface defining a summit; a second substantially horizontal surface, extending outwardly from said first downwardly directed side surface; and a second downwardly directed side surface, extending outwardly from said second substantially horizontal surface.

* * * * *